US006273550B1

(12) United States Patent
Brown

(10) Patent No.: US 6,273,550 B1
(45) Date of Patent: Aug. 14, 2001

(54) INKJET PRINTER CAPABLE OF MINIMIZING CHROMATIC VARIATION IN ADJACENT PRINT SWATHS WHEN PRINTING COLOR IMAGES IN BIDIRECTIONAL MODE

(75) Inventor: Christopher M. Brown, Phoenix, AZ (US)

(73) Assignee: Mutoh Industries Inc., Tokyo (JP)

( * ) Notice: Subject to any disclaimer, the term of this patent is extended or adjusted under 35 U.S.C. 154(b) by 0 days.

(21) Appl. No.: 09/511,854

(22) Filed: Feb. 23, 2000

(51) Int. Cl.[7] ..... B41J 2/21; B41J 29/38
(52) U.S. Cl. ..... 347/43; 347/9
(58) Field of Search ..... 347/43, 40, 9, 347/14, 47, 15

(56) References Cited

U.S. PATENT DOCUMENTS

| | | | | |
|---|---|---|---|---|
| 4,207,579 | | 6/1980 | Gamblin et al. | 346/75 |
| 4,528,576 | | 7/1985 | Koumura et al. | 346/140 R |
| 4,593,295 | * | 6/1986 | Matsufuji et al. | 347/43 |
| 4,952,942 | * | 8/1990 | Kanome et al. | 347/43 |
| 5,949,453 | | 9/1999 | Harris et al. | 347/43 |

FOREIGN PATENT DOCUMENTS

| | | | | |
|---|---|---|---|---|
| 0610096 | | 8/1994 | (EP) . | |
| 0646460 | | 4/1995 | (EP) . | |
| 0661870 | | 7/1995 | (EP) . | |
| 0955174 | | 11/1999 | (EP) . | |
| 0247075 | | 2/1990 | (JP) . | |
| 0345351 | | 2/1991 | (JP) . | |
| 345351 | * | 2/1991 | (JP) | 347/43 |
| 7195715 | | 8/1995 | (JP) . | |
| 8295034 | | 11/1996 | (JP) . | |

* cited by examiner

*Primary Examiner*—Thinh Nguyen
(74) *Attorney, Agent, or Firm*—Webb Ziesenheim Logsdon Orkin & Hanson, P.C.

(57) ABSTRACT

An inkjet printer capable of minimizing chromatic variation due to an ink overlapping (or overlaying) order when printing in a bidirectional mode. The inkjet printer comprises an inkjet head that has a plurality of inkjet nozzles. The nozzles include at least one nozzle for firing the darkest color ink, at least one nozzle for firing the brightest color ink and at least one nozzle for firing a mid-color ink. The nozzle for firing the brightest color ink can be located downstream from or the nozzle for firing the darkest color ink can be located upstream to the nozzle for firing a mid-color ink whenever the inkjet head travels in the main scan direction regardless to both directional passes.

6 Claims, 10 Drawing Sheets

Printing Order

| Pass | 1 | 2 | 3 | 4 |
|---|---|---|---|---|
| ← L | K1 | C3 | M4 | Y5 |
| → R | K6 | M4 | C3 | Y2 |
| Pass | 1 | 2 | 3 | 4 |

Printing Order

| Pass | 1 | 2 | 3 | 4 |
|---|---|---|---|---|
| ← L | K2 | C3 | M4 | Y6 |
| → R | K5 | M4 | C3 | Y1 |
| Pass | 1 | 2 | 3 | 4 |

Printing Order

| Pass | 1 | 2 | 3 | 4 |
|---|---|---|---|---|
| ← L | K1 | C3 | M4 | Y6 |
| → R | K5 | M4 | C3 | Y2 |
| Pass | 1 | 2 | 3 | 4 |

Printing Order

| Pass | 1 | 2 | 3 |
|---|---|---|---|
| ← L | C2 | M3 | Y4 |
| → R | M3 | C2 | Y1 |
| Pass | 1 | 2 | 3 |

INKJET PRINTER CAPABLE OF MINIMIZING CHROMATIC VARIATION IN ADJACENT PRINT SWATHS WHEN PRINTING COLOR IMAGES IN BIDIRECTIONAL MODE

BACKGROUND OF THE INVENTION

1. Field of the Invention

The present invention relates to an inkjet printer designed to print color images comprised of process colors as defined by the subtractive color model, and more particularly to an inkjet printer capable of reducing and/or eliminating chromatic variation in adjacent print swaths when printing in a bidirectional mode.

2. Description of the Related Art

There have been known such output devices of inkjet, laser beam, thermal, and thermal transfer types, as printers for computers and word processors and raster plotters for CAD systems in the art.

Among those, an inkjet printer is possible to print a high-precision image at a high-speed by firing inks on a print medium such as paper from a print head. The inkjet printers have grown popular for the public use along with the current widespread use of computers. The most employed color printers are such types that are capable of firing several color inks from one print head. In particular, they can be used mostly for printing images with multi-color/multi-tone processed by the computers.

In such the inkjet printer, the print head is scanned in a direction across a print paper (the main scan direction) in order to print a printable region per scan. At the same time, the print paper is advanced in a direction perpendicular to the main scan direction (the sub scan direction). The print head generally comprises a plurality of head-segments arrayed in the main scan direction. Each head-segment responds to each ink color. Each head-segment has a plurality of nozzles arranged at different locations in the sub scan direction. A color printing is performed in accordance with the subtractive color model. The subtractive color model is represented typically with a combination, CMY, of cyan (C), magenta (M) and yellow (Y) inks or a more common combination, CMYK, of CMY plus black (K) ink. There are various extensions such as CMYK plus light-density magenta (LM) and light-density cyan (LC), light-density black, and/or spot colors of orange, green, red and blue.

A common configuration would currently be a print head with four head-segments, one per color, arranged in a nozzle order of KCMY so that when printing in a unidirectional mode the K ink is the first to be placed on the print paper, followed by C, M, and finally Y ink.

The limitation of this design is that, should the printer be designed to print in a bidirectional mode, to improve overall print speed, each alternate print swath (the reverse print swath) would be created by placing the Y ink on the paper first, followed by M, C, and finally K ink contrarily to the forward print swath.

The result of this method of printing is a noticeable chromatic variation in adjacent print swaths, since a swath printed with an ink order of K, C, M, and Y would appear "lighter" to the human observer than a swath printed with an ink order of Y, M, C, and K. This phenomenon is due to the fact that each of the four standard subtractive process colors has a unique brightness distinguishable to the human eye.

The KCMY method of printing is based on the notion that optimum color reproduction is achieved with the subtractive color process by printing the darkest color, black (K), first followed by a brighter color than black, cyan(C), and so on. As an example, in a six-color system comprised of KCMY plus LC and LM, the LC and LM follow Y in the optimum order of lay down.

However, because both print speed and image quality must be balanced to achieve optimum commercial viability, along with responding to the demands from the market including a rapid shipment and cost-down, most inkjet printers support a bidirectional print mode, which has the effect of reducing print time by a factor of 25 to 30 percent compared to the unidirectional print mode.

This increase in print speed, however, can normally only be achieved by sacrificing image quality, specifically a noticeable "banding" that occurs in parts of, or on occasion throughout the entire image. This phenomenon can be reduced by interleaving print swaths, but cannot be entirely eliminated.

FIGS. 9A–C illustrate a theoretical model of an interleaved print swath using a print head with a vertical dot pitch of $1/18^{th}$ inch, printing with a horizontal resolution of 360 dots-per-inch (dpi).

As shown in FIG. 9A, when a print head 100 travels forward on a first pass (shown by an arrow R1) in the main scan direction first, ink nozzles 101 mounted on the print head 100 fire inks, creating a printed part with a horizontal resolution of 360 dpi and a vertical resolution of 180 dpi. In this forward print operation, all dots are printed in KCMY order: the brightest color is printed finally.

The print head 100 is then stepped a certain distance (for example, a ½-tall print swath) down in the sub scan direction as shown in FIG. 9B, and the print head 100 travels reverse on a second pass in the main scan direction. At the same time, inks are fired from the ink nozzles 101 to create a printed part with a horizontal resolution of 360 dpi and a vertical resolution of 180 dpi. As a result of these forward and reverse print operations, a ½-tall full dot print swath SWT1 is created with both horizontal and vertical resolutions of 360 dpi. In this reverse print operation, all dots are printed in YMCK order: the darkest color is printed finally.

The print head 100 is further stepped a certain distance down in the sub scan direction as shown in FIG. 9C, the print head 100 travels on the first pass again (shown by an arrow R2). At the same time, inks are fired from the ink nozzles 101 to create a printed part with a horizontal resolution of 360 dpi and a vertical resolution of 180 dpi. As a result of these reverse and forward print operations, another ½-tall full dot print swath SWT2 is created with both horizontal and vertical resolutions of 360 dpi. In this forward print operation, all dots are printed in KCMY order: the brightest color is printed again finally.

A study of the theoretical model illustrated above would indicate that interleaving each print swath would eliminate chromatic variation in adjacent print swaths, since each swath would consist of an equal number of vertically interlaced dots of alternating density. However, the above model does not take into account the phenomenon of dot gain, which results in a small overlapping of adjacent dots.

Dot gain occurs when an ink droplet of a given size increases in diameter as it dries on the substrate surface. This mechanism is necessary to ensure optimum image quality and color saturation; without adequate dot gain, a printed image will appear "washed out," since too much of the underlying surface (typically white in color) would show through between the gaps in the dots.

FIG. 10 details the dot gain in the above theoretical model.

As shown in FIG. 10A, when the print head 100 performs the reverse operation, low-brightness dots D2 are laid on top of high-brightness dots D1. Dot gain in this case gives "darker" impression to the human eye as seen from the printed result 110*a*. To the contrary, when the print head 100 performs the second forward operation as shown in FIG. 10B, high-brightness dots D1 are laid on top of low-brightness dots D2, resulting in "lighter" impression as seen from the printed result 110*b*. A complete printed image obtained through such the print operations can be observed darker in the swath SWT1 in case of right-to-left operations (L1, L2, . . . , Ln) performed by the print head, and lighter in the swath SWT2 in case of left-to-right operations (R1, R2, . . . , Rn). Higher vertical resolution is often achieved by tighter interleaving of each print swath, chromatic variations tend to become less noticeable on higher resolution printers. However, the degree of chromatic variation such as banding in adjacent print swaths remains the same.

SUMMARY OF THE INVENTION

The present invention is made in consideration of such the disadvantages and accordingly has an object to provide an inkjet printer capable of effectively preventing chromatic variations such as banding due to color overlapping (or overlaying) order variations during printing in a bidirectional mode.

The present invention is provided with an inkjet printer, which comprises an inkjet head having a plurality of nozzles arrayed in the main scan direction, each for firing a different color ink. The inkjet printer also comprise head control means for driving the inkjet head relative to a print medium in the main scan direction and the sub scan direction perpendicular to the main scan direction and for providing the inkjet head with firing pulses to fire inks in synchronization with the driving said inkjet head. Droplets of the inks fired from the nozzles for respective colors are overlapped (or overlaid) at each dot-forming position on the print medium to form a color image. The inkjet head includes at least one nozzle for firing a mid-bright color ink and at least one nozzle for firing the brightest color ink so that the nozzle for firing the brightest color ink is located downstream from the nozzle for firing a mid-bright color ink when the inkjet head travels in the main scan direction regardless to both directional passes. The control means provides the inkjet head with the firing pulses in such a manner that a combination of the nozzles for firing a mid-bright and the brightest color inks in case of the inkjet head traveling on a first directional pass in the main scan direction differs from that in case of said inkjet head traveling on a second directional pass opposite to the first directional pass and that said inks are fired onto one dot-forming position from the nozzle for firing a mid-bright color ink first followed by the nozzle for firing the brightest color ink in both cases of the first and second directional passes.

The inkjet head for the inkjet printer according to the present invention may include the following types. A first example would be an inkjet head, which preferably includes at least one nozzle for firing the darkest color ink arrayed in the main scan direction so that the nozzle for firing the darkest color ink is located upstream to the nozzle for firing a mid-bright color ink when the inkjet head travels in the main scan direction regardless to both directional passes.

In this case, the control means may preferably provides a firing pulse to said nozzle for firing a mid-bright color ink after providing a firing pulse to the nozzle for firing the darkest color ink when the inkjet head travels on the first directional pass.

A second example would be an inkjet head, which includes six head-segments arrayed in the main scan direction, each head-segment having a plurality of nozzles arranged at different locations in the sub scan direction. The six head-segments contains two sets of head-segments, each set consisting of two head-segments for firing the darkest and brightest color inks and located outside two inner head-segments for firing it mid-color inks.

In this case, the control means may preferably provide the firing pulses, with respect to one dot-forming position, to the head-segment for firing the darkest color ink in the preceding set, the head-segment for firing a mid-color ink, and the head-segment for firing the brightest color ink in the following set, in this order.

A third example would be an inkjet head, which may include four head-segments arrayed in the main scan direction, two head-segments for firing the brightest color inks respectively located outside two inner head-segments for firing mid-color inks.

In this case, the control means may preferably provide the firing pulses, with respect to one dot-forming position, to the head-segment for firing a mid-color ink and the following head-segment for firing the brightest color ink, in this order.

The colors of the inks fired from the nozzles in the inkjet heads according to the present invention may preferably be that the brightest color is yellow (Y) and the mid-colors are cyan (C) and magenta (M).

The colors of the inks fired from the nozzles in the first and second inkjet heads may preferably be that the darkest color is black (K), the brightest color is yellow (Y) and the mid-colors are cyan (C) and magenta (M).

The colors of the inks fired from the nozzles in the second inkjet head may preferably be that the darkest color is black (K). In this case, the control means provides the firing pulses alternately to black head-segments contained in the respective sets to realize a double speed monochromic printing compared to color printing.

According to the present invention, the inkjet nozzle array of the inkjet head in the inkjet printer is modified to control the ink firing order. This enables to print one dot position in a maintained ink firing order when the inkjet head travels on either of both directional passes in the main scan direction. Therefore, it is possible to reduce and/or eliminate chromatic variations such as banding due to the ink overlapping order.

Other features and advantages of the invention will be apparent from the following description of the preferred embodiments thereof.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

The present invention will be described next with reference to the drawings.

Figure 1:
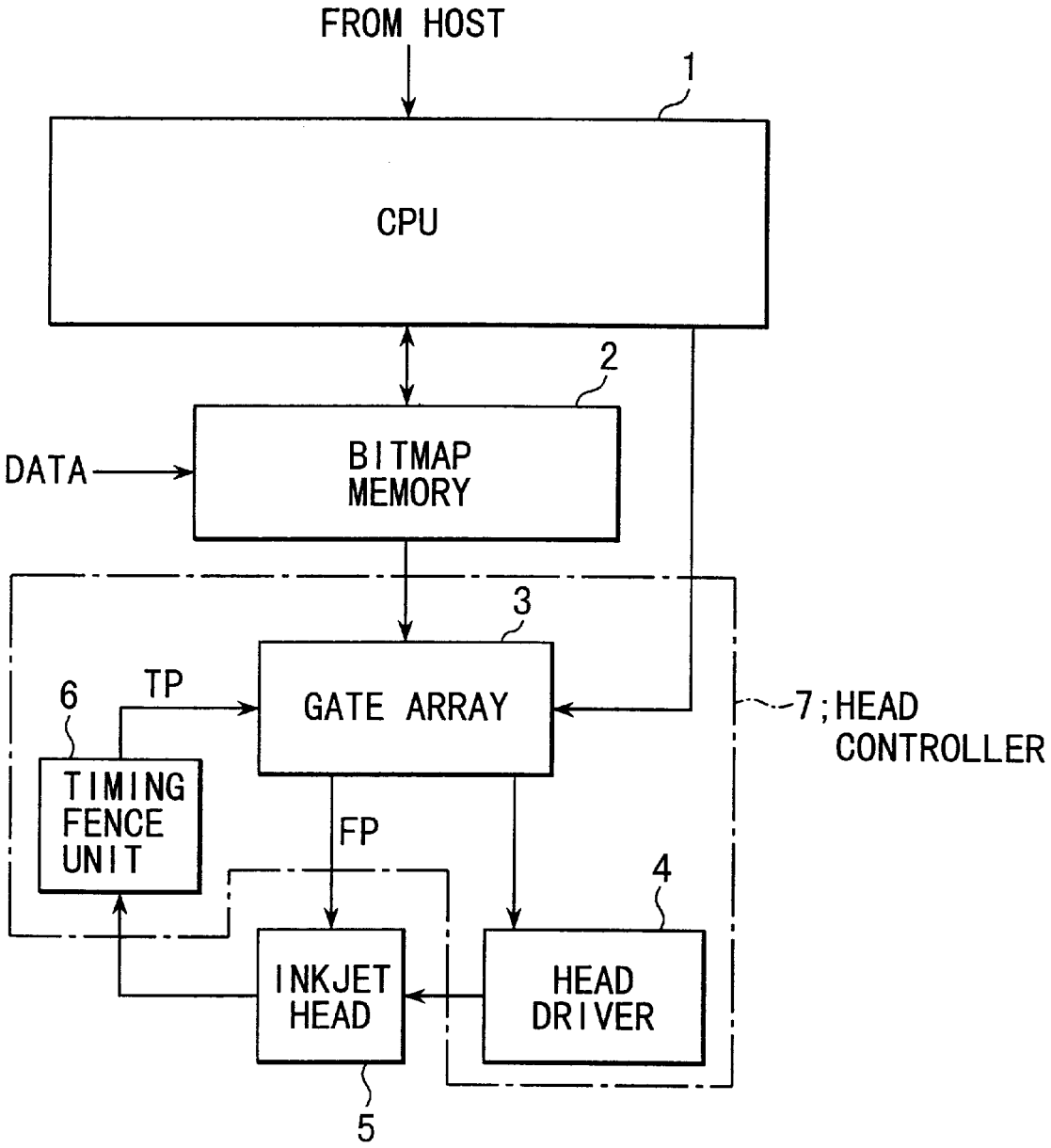
FIG. 1 is a block diagram showing a partial configuration of an inkjet printer according to an embodiment of the present invention.

FIG. 1 is a block diagram showing a partial configuration of an inkjet printer according to an embodiment of the present invention.

Image data to be printed out, such as TIFF, JPEG, MR, MMR and CALS, sent from the non-depicted host system is supplied to a CPU 1. The CPU 1 converts the input image data into bitmap data through decoding, color converting and tone processing, and stores the result in a bitmap memory 2. The bitmap data stored in the bitmap memory 2 is printed out onto a non-depicted print paper by an inkjet head 5 that is driven under control of a head controller 7. The head controller 7 comprises a gate array 3, a head driver 4 and a timing fence unit 6. The gate array 3 outputs timing signals for driving the head, to the head driver 4. The head driver 4 drives the inkjet head 5 in a direction across the print paper (the main scan direction) and also drives the print paper in a direction perpendicular to the main scan direction (the sub scan direction) based on the timing signals. The timing fence unit 6 includes a linear encoder to detect a position of the inkjet head 5 and outputs a timing fence signal TP to the gate array 3 when the inkjet head 5 travels every certain distance in the main scan direction. The gate array 3 outputs the timing signals to the head driver 4 based on the timing fence signal TP. The gate array 3 also outputs firing pulses FP for determining ink firing timings, to the inkjet head 5 based on the timing fence signal TP.

Figure 2:
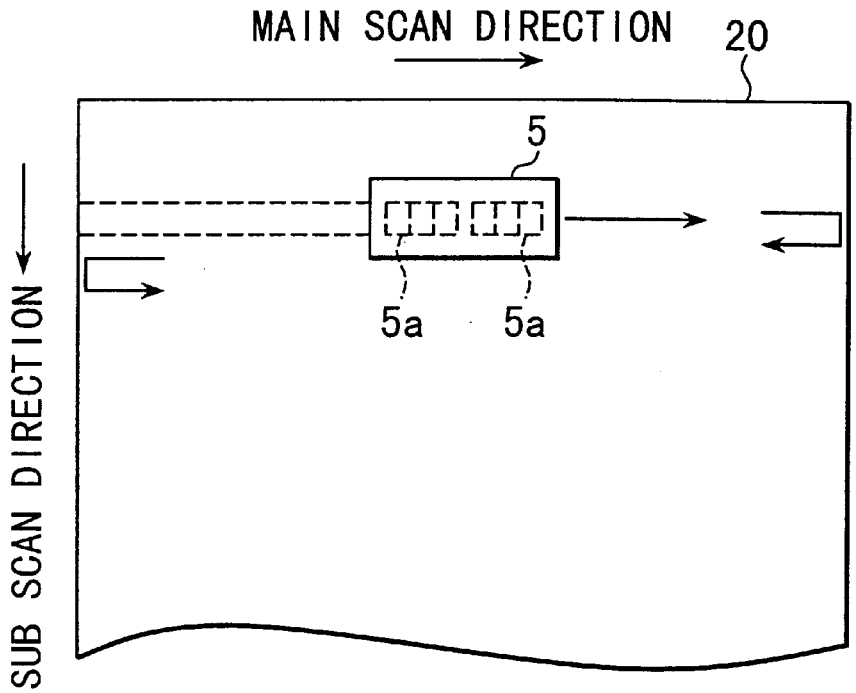
FIG. 2 illustrates motions of the inkjet head relative to a print paper in the above printer.

FIG. 2 illustrates motions of the inkjet head 5 relative to a print paper 20.

Figure 3:
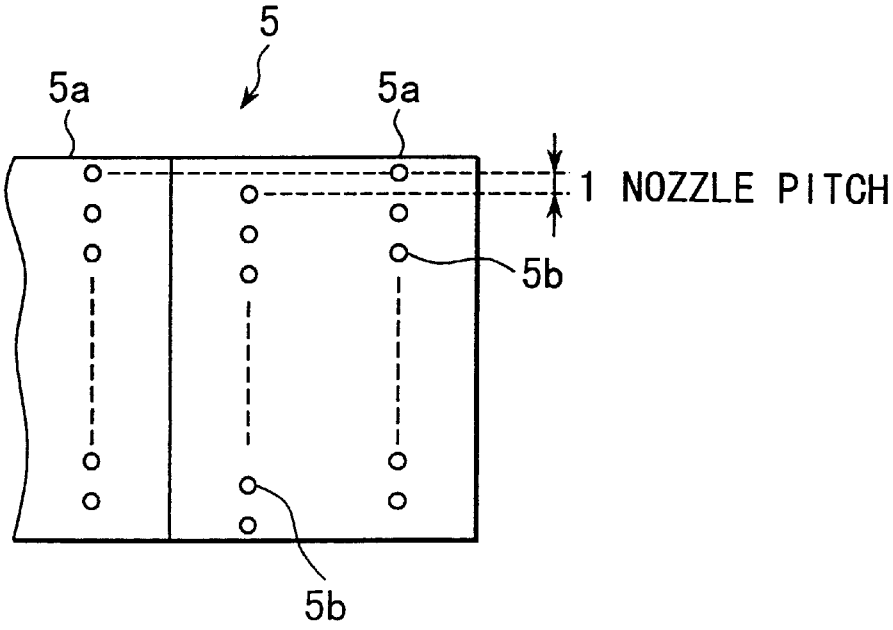
FIG. 3 exemplifies an arrangement of nozzles of the inkjet head in the above printer.

The inkjet head 5 is driven forward and reverse in the main scan direction on the print paper 20. The print paper 20 is driven in the sub scan direction at each end of forward and reverse operations of the inkjet head 5. The inkjet head 5 consists of a plurality of head-segments 5*a* arrayed in the main scan direction for firing different color inks. Each head-segment 5*a* consists of a plurality of nozzles 5*b* for firing the same color inks as shown in FIG. 3. Although these nozzles 5*b* can be arranged in an array along the sub scan direction, they are located in such a zigzag manner that every nozzle alternates its position in the main scan direction as depicted for the convenience of arrangement of the nozzles.

Figure 4A:
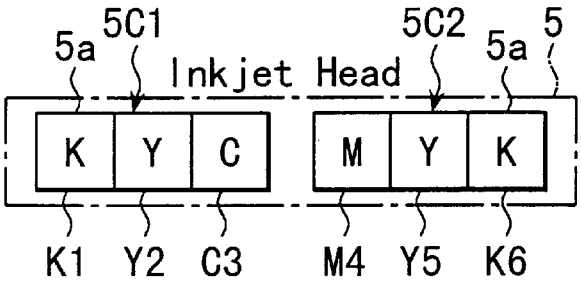
FIG. 4A exemplifies a first arrangement of the inkjet head and method of driving the same in the above printer and FIG. 4B illustrates the order ink dots are laid upon the paper for the L pass and the R pass.
Figure 4B:
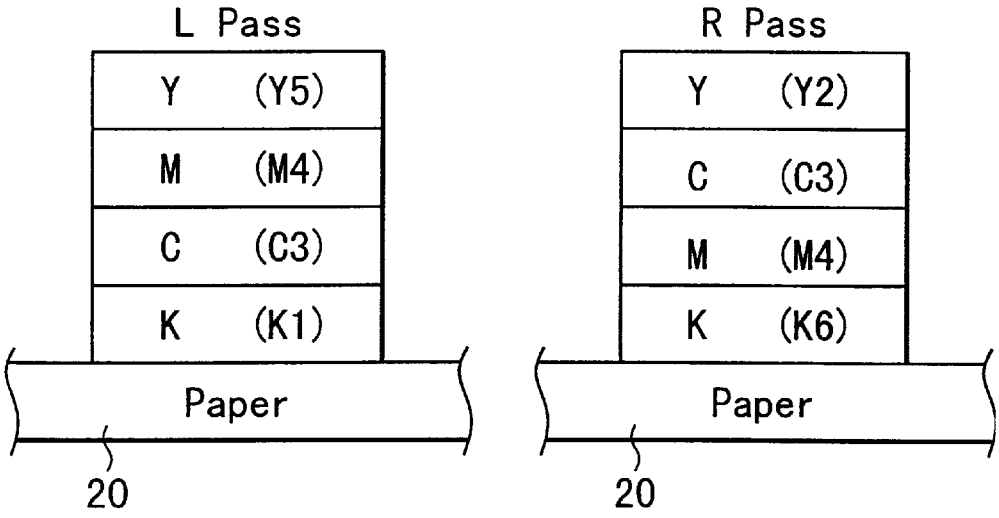

FIG. 4 exemplifies a first arrangement of the inkjet head 5 and method of driving it in the above printer.

The inkjet head 5 comprises two sets of head-segment groups 5C1 and 5C2 arrayed in the main scan direction as shown in FIG. 4A. One head-segment group 5C1 includes three head-segments 5*a* (K1, Y2, C3) for firing KYC color inks, respectively. The other head-segment group 5C2 includes three head-segments 5*a* (M4, Y5, K6) for firing MYK color inks, respectively. Each head-segment 5*a* can be driven independently. The head-segment groups 5C1 and 5C2 may respectively be composed of a three-color composite head that includes three head-segments 5*a*.

When the inkjet head 5 travels in a direction shown with an arrow L (a right-to-left movement: hereinafter referred to as an L-pass), the head-segments K1, C3, M4 and YS fire inks in turn so that overlapped inks can print KCMY.

When the head travels to the contrary in a direction shown with an arrow R (a left-to-right movement: hereinafter referred to as a R-pass), the head-segments K6, M4, C3 and Y2 fire inks in turn so that overlapped inks can print KMCY. A combination of specific colors (for example, red and green) in the bidirectional print mode easily causes noticeable chromatic variations in general. In particular, this phenomenon becomes extremely noticeable when black (K) ink is employed even a slight amount. Accordingly, chromatic variations when alternately printing KCMY and KMCY using the inkjet head 5 as configured in this embodiment are less noticeable than when alternately printing KCMY and YMCK using the conventional inkjet head with KCMY array. Namely, by preventing the ink order of K and Y in the printed result from reversing, chromatic variations in adjacent print swaths can be minimized and thus chromatic variations can be eliminated in almost all colors.

Figure 5A:
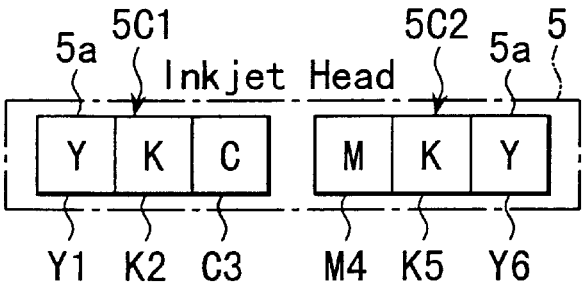
FIGS. 5A and 5B exemplify other head-segment arrangement of the inkjet head in the above printer.

The above is only an example of six head-segments and similar concept can be found in other arrangements. For instance, the head-segment group 5C1 may include three head-segments 5*a* (Y1, K2, C3) for firing YKC color inks and the head-segment group 5C2 may include three head-segments 5*a* (M4, K5, Y6) for firing MKY color inks as shown in FIG. 5A. It is possible to minimize chromatic variations in this case similar to the first embodiment by firing from the head-segment K2, C3, M4 and Y6 in turn on the L-pass and on the other hand from the head-segments KS, M4, C3 and Y1 in turn on the R-pass.

Figure 5B:
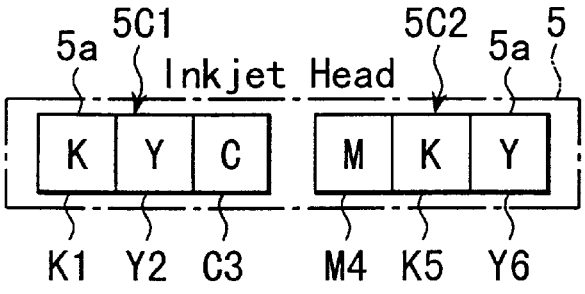

The head-segment group 5C1 may also include three head-segments 5*a* (K1, Y2, C3) for firing KYC color inks and the head-segment group 5C2 may also include three head-segments 5*a* (M4, KS, Y6) for firing MKY color inks as shown in FIG. 5B. It is also possible to minimize chromatic variations in this case by firing from the head-segment K1, C3, M4 and Y6 in turn on the L-pass and from the head-segments K5, M4, C3 and Y2 in turn on the R-pass.

Since the above mentioned inkjet head 5 of 6-head-segment type includes two K color head-segments 5*a* in the main scan direction, a high-speed monochrome printing can be achieved at about double the normal print speed as shown in FIG. 6. This is performed by driving only head-segments K1 and K6 in the inkjet head 5 of FIG. 4, transporting the inkjet head 5 at a double speed of the ink firing frequency, and applying firing pulses so that K1 and K6 may operate alternately on every other dot.

Figure 6A:
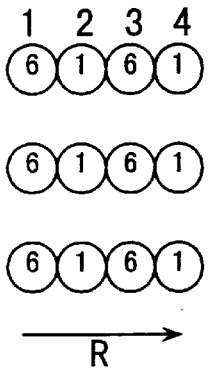
FIGS. 6A and 6B exemplify right and left pass drive methods for monochrome printing by the inkjet head in the above printer.
Figure 6B:
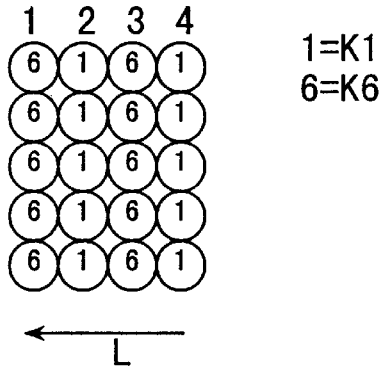

In this case during the printing the heads K1 and K6 fire inks on even and odd dots in the R-pass as shown in FIG. 6A and alternately on odd and even dots in the L-pass as shown in FIG. 6B. A head transport speed (HTS) of 22.2 inches/second (ips) would be sufficient to print, for example, with a horizontal resolution of 360 dpi, with a print nozzle pulse rate of 8 kHz (8000 pulses/second/nozzle). To increase this, two print heads can be positioned inline so that one head prints odd dots and the other head prints even dots. As a result, a high-speed monochrome mode can be achieved at an HTS of 44.4 ips. For this to work, two inkjet heads must have equal number of inkjet nozzles and equal nozzle pitches and each nozzle must have its own driver.

FIG. 7 exemplifies another arrangement of the inkjet head 5 and method of driving it in the above printer.

Figure 7A:
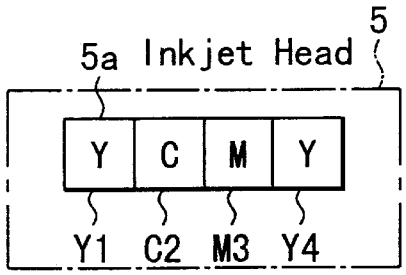
FIG. 7A exemplifies another arrangement of the inkjet head and method of driving the same in the above printer and FIG. 7B illustrates the order ink dots are laid upon the paper for the L pass and the R pass.

This inkjet head 5 comprises four head-segments 5*a* (Y1, C2, M3, Y4) for firing YCMY color inks as shown in FIG. 7A.

A common design for many low-cost inkjet printers is to use a single array of four heads, or a single composite head with four independent nozzle segments. In such a configuration, the printer is equipped with C, M, Y, and K inks, and printing is performed in KCMY fashion. However, for printers designed to reproduce raster images, e.g. photographs and/or computer-generated artwork, the K segment is not absolutely necessary. In fact, the standard color model for subtractive color is CMY, not CMYK, although K is added for improved text quality and to better control image contrast. The method of this embodiment is intended to balance image quality and speed, by trading the quality gain of adding K with the quality lost to chromatic errors generated in bidirectional mode.

Figure 7B:
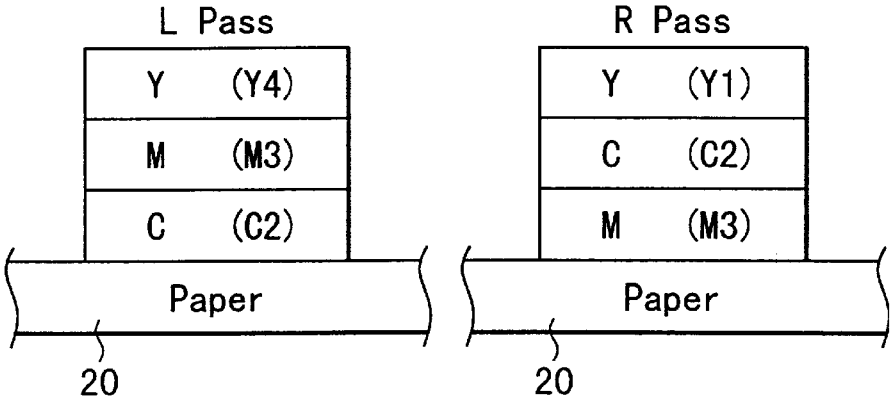

When the inkjet head 5 travels in the L-pass as shown in FIG. 7A, the head-segments C2, M3 and Y4 fire inks in turn to print on the print paper 20 with overlapped CMY inks as shown in FIG. 7B. When the head travels on the other hand in the R-pass, the head-segments M3, C2 and Y1 fire inks in turn to print on the print paper 20 with overlapped CMY inks as shown in FIG. 7B. As a result, the inkjet head 5 that consists of four print heads but does not include K ink can achieve an optimum bidirectional printing.

Figure 8A:
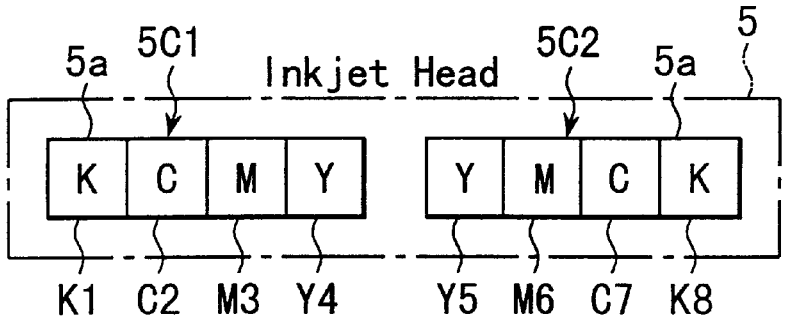
FIG. 8 exemplifies a different arrangement of the inkjet head in the above printer.
Figure 8B:
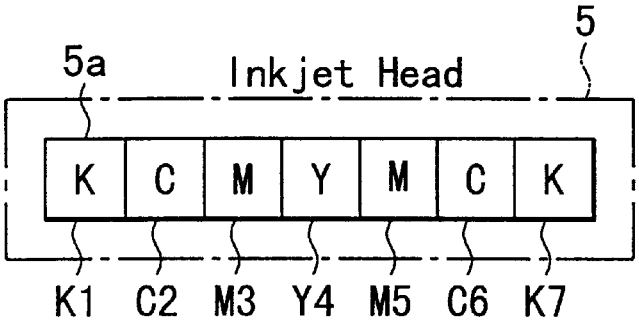
Figure 8C:
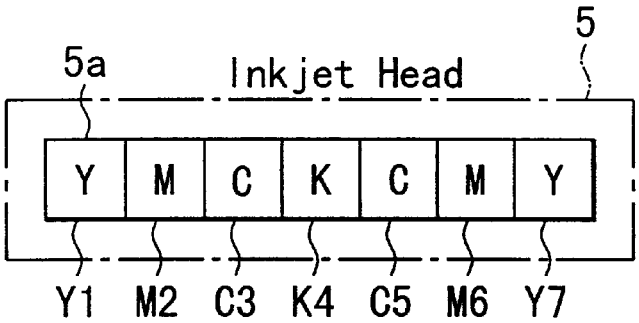
Figure 8D:
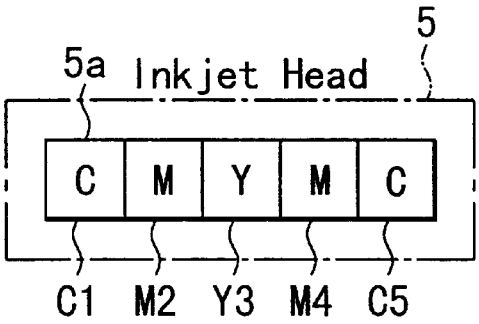
Figure 9A:
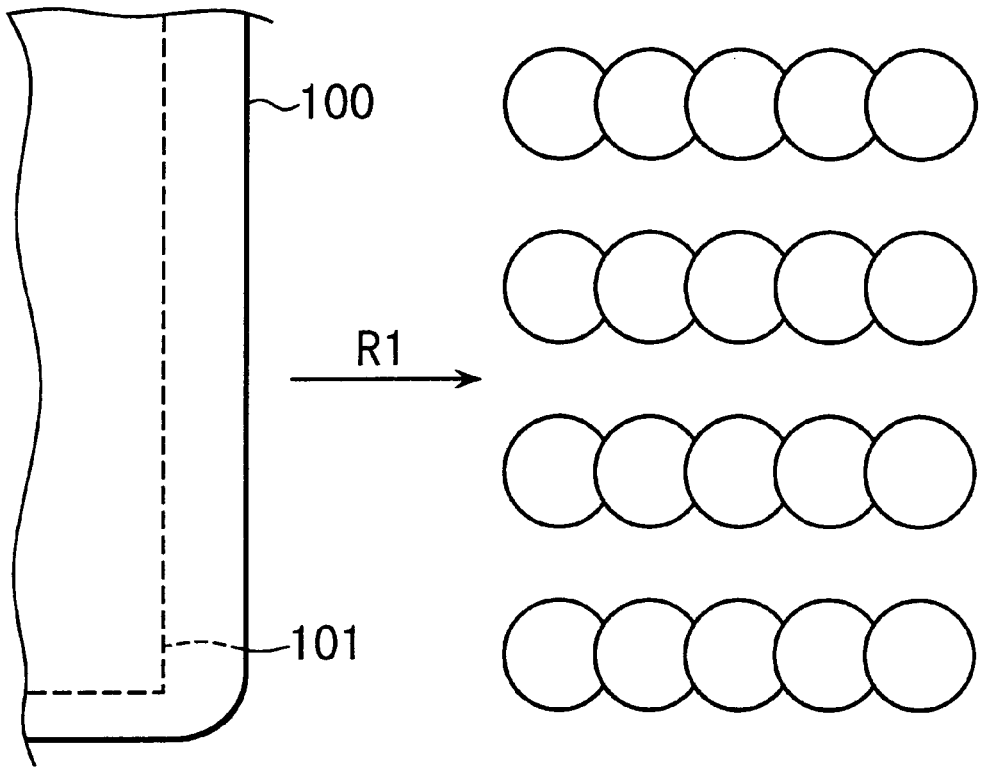
FIG. 9A shows a theoretical model in case of printing in an interleaving mode by the conventional inkjet printer.
Figure 9B:
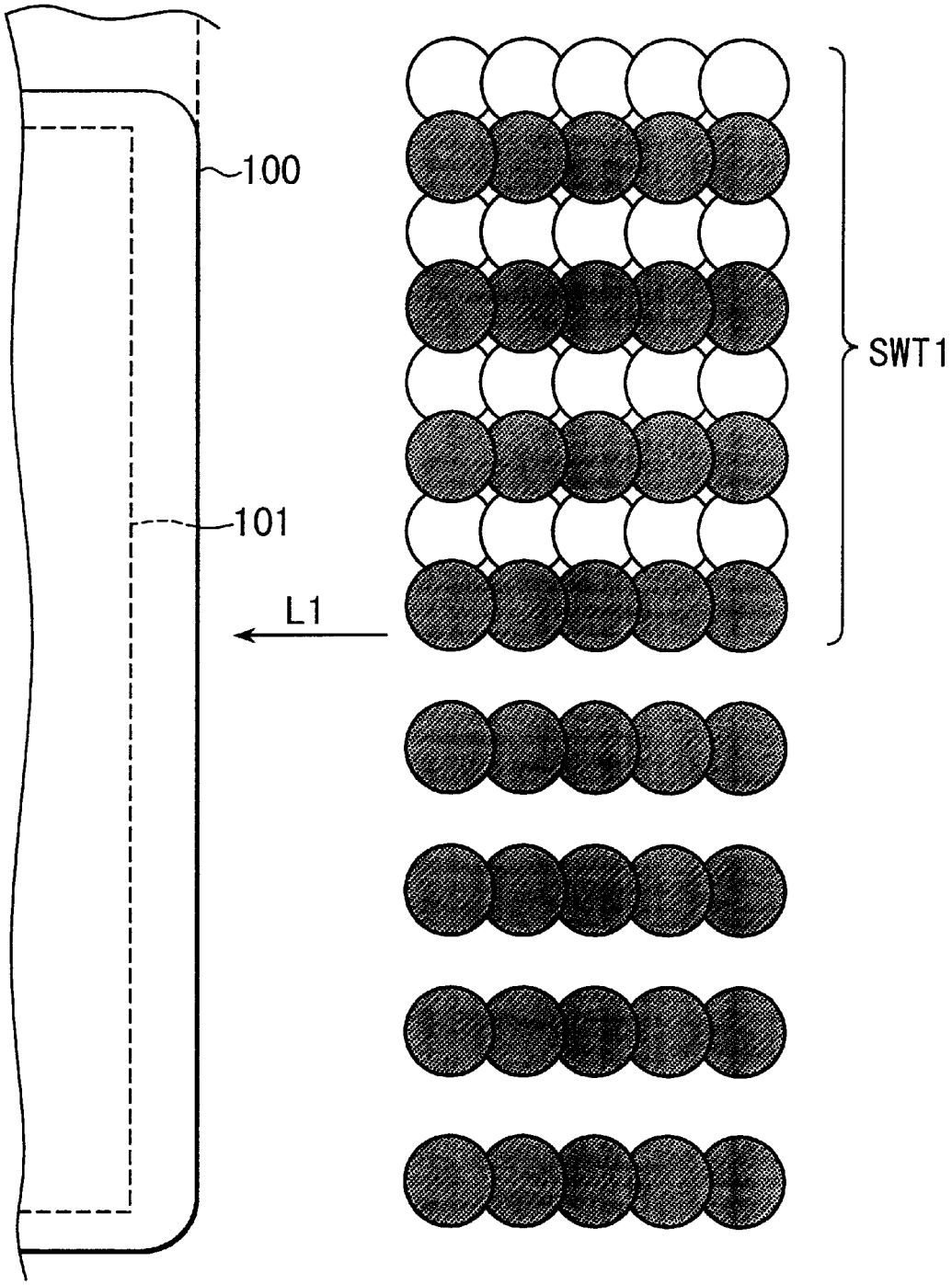
FIG. 9B shows the theoretical model in case of printing in the interleaving mode by the conventional inkjet printer.
Figure 9C:
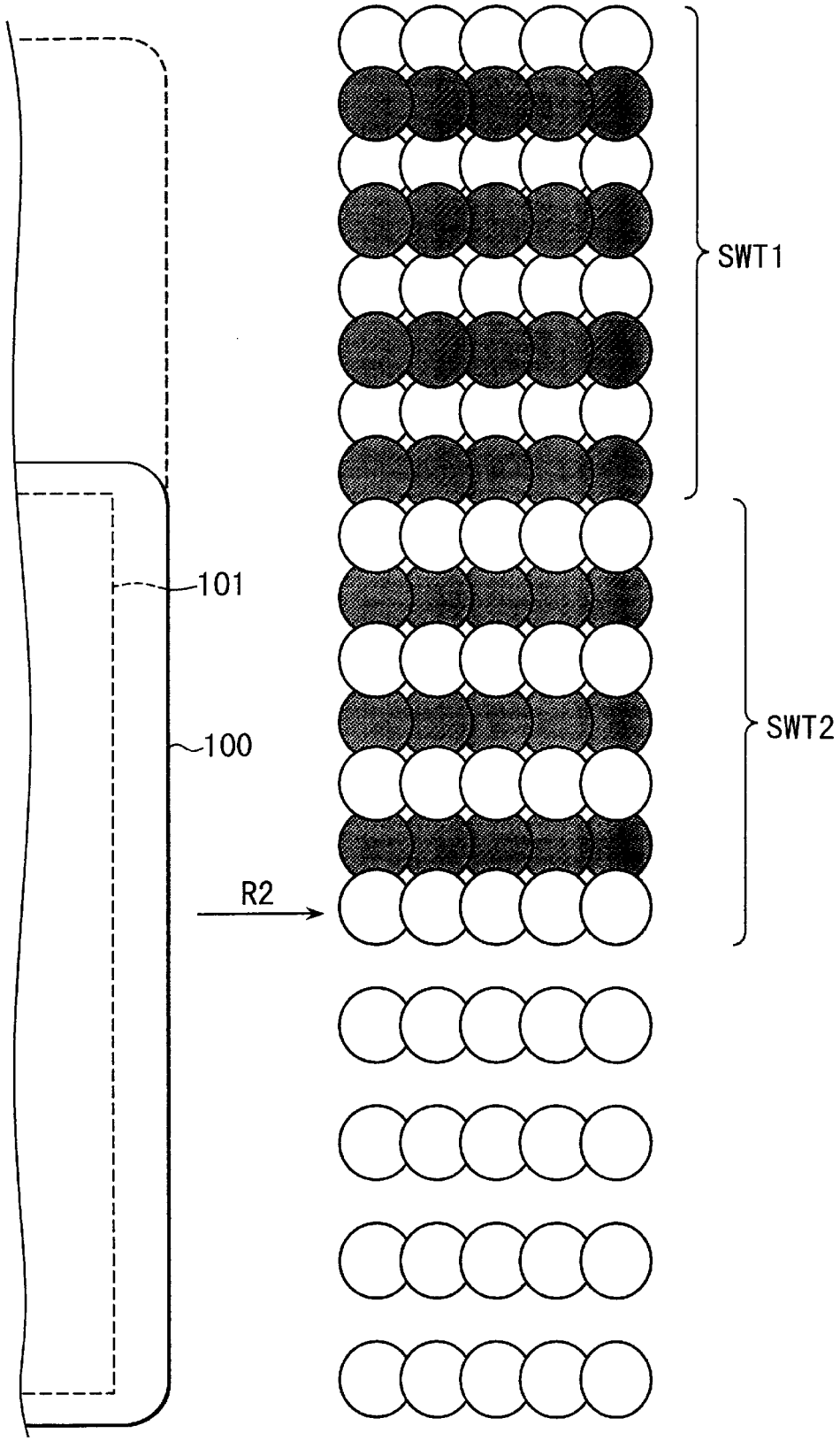
FIG. 9C shows the theoretical model in case of printing in the interleaving mode by the conventional inkjet printer.
Figure 10A:
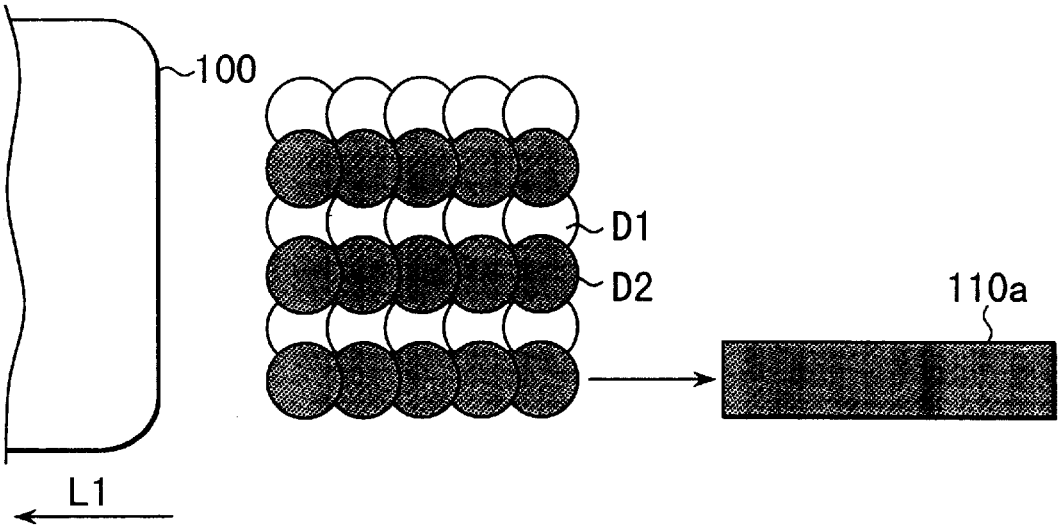
FIG. 10A details theoretical dot gain for the left pass and FIG. 10B details theoretical dot gain for the right pass.
Figure 10B:
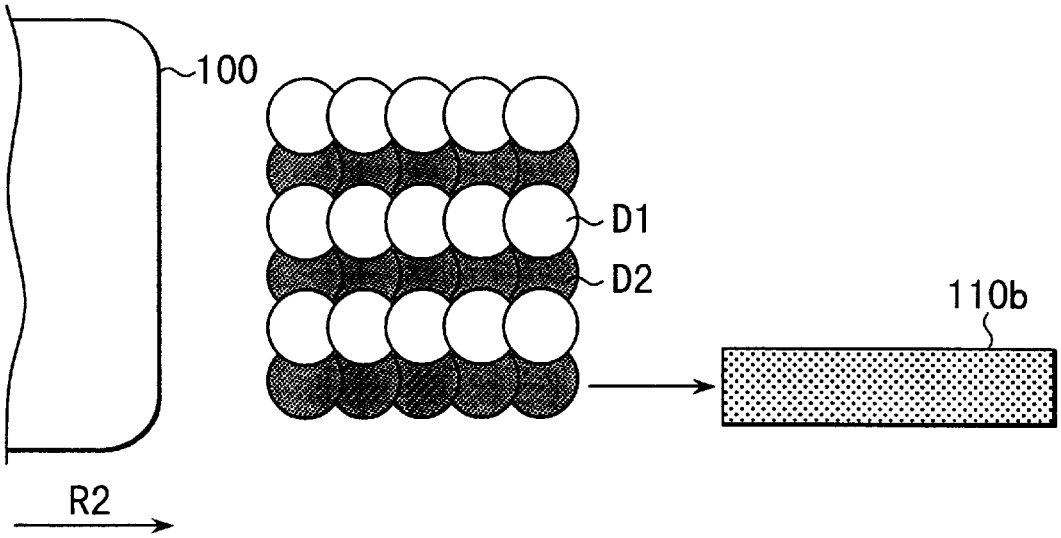

The configuration of the inkjet head for use in the inkjet printer according to the present invention is not limited to the above examples. FIG. 8A shows a possible configuration, in which one head-segment group SC consists of four head-segments 5*a* (K1, C2, M3, Y4) for firing KCMY color inks and the other head-segment group 5C2 four head-segments 5*a* (Y5, M6, C7, K8) for firing YMCK color inks. FIG. 8B shows another possible configuration that consists of seven head-segments 5*a* (K1, C2, M3, Y4, M5, C6, K7) for firing KCMYMCK color inks. FIG. 8C shows a further possible configuration that consists of seven head-segments 5*a* (Y1, M2, C3, K4, C5, M6, Y7) for firing YMCKCMY color inks. The inkjet head 5 that does not include K may also be configured with five head-segments 5*a* (C1, M2, Y3, M4, C5) for firing CMYMC color inks, for example, as shown in FIG. 8D. In summary, it is sufficient to pluralize at least one of head-segments for firing the mid-bright and the brightest color inks.

Having described the embodiments consistent with the present invention, other embodiments and variations consistent with the present invention will be apparent to those skilled in the art. Therefore, the invention should not be viewed as limited to the disclosed embodiments but rather should be viewed as limited only by the spirit and scope of the appended claims.

What is claimed is:

1. An inset printer, comprising:

an inkjet head having a plurality of nozzles arrayed in the main scan direction, each for firing a different color ink; and head control means for driving said inkjet head relative to a print medium in the main scan direction and the sub scan direction perpendicular to the main scan direction and for providing said inkjet head with firing pulses to fire inks in synchronization with said driving said inkjet head, in which droplets of said inks fired from said nozzles for respective colors are overlapped at each dot-forming position on said print medium to form a color image, wherein said inkjet head comprises six head-segment arrayed in the main scan direction, each head-segment having a plurality of nozzles arrayed at different locations in said sub scan direction, said six head-segments comprising two inside head-segments for firing two different mid-bright color inks locate on the inside of The six head-segments and two pair of outside head-segments being located on opposite sides of said to inside head-segments, said each outside pair of head-segments firing the darkest and brightest color inks, respectively, and said control means provides said inkjet head with said firing pulses in such a manner that a combination of said six head-segments in case of said inkjet head traveling on a first directional pass in the main scan direction differs from that in case of said inkjet head traveling on a second directional pass opposite to said first directional pass and such that said inks are fired onto one dot-forming position from said nozzles in the order darkest color ink, the mid-bright color ink and the brightest color ink in both cases of said first and second directional passes.

2. The inkjet printer according to claim 1, wherein said brightest color is yellow (Y) and said mid-bright colors are cyan (C) and magenta (M).

3. The inkjet printer of claim 1, wherein said darkest color is black (K), said brightest color is yellow (Y) and said mid-bright colors are cyan (C) and magenta (M).

4. The inkjet printer of claim 1, wherein said darkest color is black (K), and said control means provides said firing pulses alternately to black head-segments contained in said respective sets to realize a double speed monochromic printing compared to a color printing.

5. An inkjet printer, comprising:

an inkjet head having a plurality of nozzles arrayed in the main scan direction, each for firing a different color ink; and head control means for driving said inkjet head relative to a print medium in the main scan direction and the sub scan direction perpendicular to the main scan direction and for providing said inkjet head with firing pulses to fire inks in synchronization with said driving of said inkjet head wherein droplets of said inks fired from said nozzles for respective colors are overlapped at each dot-forming position on said print medium to form a color image, wherein said inkjet head includes a plurality of head-segments arrayed in the main scan direction, each head-segment having a plurality of nozzles arrayed at different locations in said sub scan direction, said plurality of head-segments comprising at least one head-segment for firing a mid-bright color ink, at least one head-segment for firing the brightest color ink and at least two head-segments for firing black as the darkest color ink so that said head-segment for firing the brightest color ink is located downstream from said head-segment for firing the mid-bright color ink and said head-segment for firing the mid-bright color ink is located downstream from one of said head-segments for firing the darkest color ink when said inkjet head travels in the main scan direction regardless to both directional passes, said control means provides said inkjet head with said firing pulses in such a manner that a combination of said head-segments for firing the darkest, the mid-bright and the brightest color inks in case of said inkjet head traveling on a first directional pass in the main scan direction differs from that in case of said inkjet head traveling on a second directional pass opposite to said first directional pass and that said inks are fired onto one dot-forming position from said head-segments for firing the darkest color ink, the mid-bright color ink and the brightest color ink in order in both cases of said first and second directional passes, and said control means provides said firing pulses alternately to headsegments for firing the darkest color ink contained in said respective sets to realize a double speed monochromic printing compared to a color printing.

6. The inkjet printer of claim 5, wherein said brightest color is yellow (Y) and said mid-bright colors are cyan (C) and magenta (M).

* * * * *

UNITED STATES PATENT AND TRADEMARK OFFICE

CERTIFICATE OF CORRECTION

PATENT NO. : 6,273,550 B1
DATED : August 14, 2001
INVENTOR(S) : Christopher M. Brown It is certified that error appears in the above-identified patent and that said Letters Patent is hereby corrected as shown below:

Column 2,
Line 20, "1/18$^{th}$" should read -- 1/180$^{th}$ --.

Column 6,
Line 13, "YS" should read -- Y5 --.
Line 42, "KS" should read -- K5 --.
Line 46, "KS" should read -- K5 --.

Column 7,
Line 38, "group SC" should read -- group 5C1 --.

Column 8, claim 1,
Line 13, "locate" should read -- located --.
Lines 13-14, "inside of The" should read -- inside of the --.

Column 10, claim 5,
Line 5, "headsegments" should read -- head-segments --.

Signed and Sealed this

Twenty-sixth Day of February, 2002

*Attest:*

*Attesting Officer*

JAMES E. ROGAN
*Director of the United States Patent and Trademark Office*